US005915599A

United States Patent [19]

Takahashi

[11] Patent Number: 5,915,599

[45] Date of Patent: Jun. 29, 1999

[54] SHOULDER COVER

[75] Inventor: Toshimi Takahashi, Yao, Japan

[73] Assignee: Takajasjo Plastic Industry Co, Osaka, Japan

[21] Appl. No.: 08/795,284

[22] Filed: Feb. 4, 1997

[30] Foreign Application Priority Data

Feb. 8, 1996 [JP] Japan ..... 8-058175
Feb. 13, 1996 [JP] Japan ..... 8-063649

[51] Int. Cl.[6] ..... B65D 83/14

[52] U.S. Cl. ..... 222/402.13; 222/182; 222/402.21; 222/541.6; 239/288.5

[58] Field of Search ..... 222/182, 402.13, 222/541.6, 402.21, 402.23; 239/288–288.5, 337

[56] References Cited

U.S. PATENT DOCUMENTS

| | | | |
|---|---|---|---|
| 3,185,349 | 5/1965 | Sagarin | 222/402.13 |
| 3,312,723 | 4/1967 | Anderson et al. | 222/402.13 |
| 3,480,184 | 11/1969 | Landis | 222/182 |
| 3,661,300 | 5/1972 | Nigro | 222/402.13 |
| 3,729,119 | 4/1973 | Sette et al. . | |
| 3,884,393 | 5/1975 | Wassilieff | 222/182 |
| 4,463,878 | 8/1984 | Crone | 222/182 |
| 4,513,889 | 4/1985 | Beard | 222/182 |
| 5,271,533 | 12/1993 | Joulia | 222/402.13 |
| 5,702,036 | 12/1997 | Ferrara, Jr. | 222/402.13 |

FOREIGN PATENT DOCUMENTS

| | | |
|---|---|---|
| 348917 | 3/1979 | Austria . |
| 2341417 | 3/1975 | Germany . |
| 8519968 | 10/1985 | Germany . |
| 1359152 | 7/1974 | United Kingdom . |
| 2049063 | 12/1980 | United Kingdom . |

*Primary Examiner*—J. Casimer Jacyna
*Attorney, Agent, or Firm*—Price Gess & Ubell

[57] ABSTRACT

The invention provides a shoulder cover for aerosol products capable of removing easily when discarding after use, while preventing perfectly from being detached from the aerosol container main body during use of product.

A hinge is provided in the direction of action of the shoulder cover fitted with the aerosol container main body, and a locking protrusion and a vertical groove capable of separating part of a ring body are provided within degrees to right and left of the hinge on the inner circumference of the ring band, thereby allowing to tear off by holding the actuator portion.

A locking protrusion is provided on the inner circumference of the ring band of the shoulder cover made of flexible resin, and a grip capable of inclining so as to flex the ring band is provided above the ring band. When desired to detach the shoulder cover from the aerosol container main body, the grip is picked up by force.

19 Claims, 9 Drawing Sheets

SHOULDER COVER

BACKGROUND OF THE INVENTION

1. Field of the Invention

The present invention relates to a shoulder cover convenient for disposal treatment of an attached used container, and more particularly to a shoulder cover placed on an aerosol product, which is not detached during use of the product, and can be separated and removed from the used container at the time of classified garbage collection after use of the product.

2. Description of the Prior Art

A decorative piece mounted to cover the valve or the upper part of the main body of an aerosol product mounted on the aerosol container, separately from the cap, is known as shoulder cover in the industry. It is important hitherto for the shoulder cover that it should not be detached easily from the aerosol container main body (the convex part or concave part of the aerosol container main body or the valve mounted on the aerosol container main body), and the attention has been concentrated on how to keep the shoulder cover from being detached during use.

Actually, however, in the process of merchandise planning or product inspection, it is sometimes needed to detach the shoulder cover from the aerosol container once it has been completed as to its product life, like the general button, spout or actuator, and although several methods have been discussed about these points, if the shoulder cover is made easily detachable from the aerosol container main body, the shoulder cover may be detached during use of the product, or the shoulder cover is broken during long-term storage, and many structural and manufacturing problems occurred. Hence, a shoulder cover in such a structure that it can be easily detached and removed after use has not been developed at all to the present.

Accordingly, in the process of merchandise planning, product inspection, or product repair, if desired to detach the shoulder cover from the aerosol container once finished as a product, it was necessary to tear off the shoulder cover by force by using screwdriver, nippers, pincers or the like, and the aerosol container was torn or broken, and it was dangerous and the product once completed must be discarded as defective.

Nevertheless, in the classified garbage collection regulation agreed at the Diet of Japan in June 1995 and published in the official gazette in December of the same year, it is designated "the container filled with high pressure gas should be deprived of the content, lid and pushbotton for injection," and further "the actuators including the shoulder cover should be easily detachable" according to the ordinance of the Ministry of Health and Welfare of Japan, and therefore unless the shoulder cover mounted on the aerosol product is designed and developed so as to be easily separated and removed from the main body of the used container, at the time of classified garbage collection after use of the product, while it is not detached during use of the product, the shoulder cover cannot be used in aerosol products.

SUMMARY OF THE INVENTION

The invention is completed in the light of the above points, and it is a primary object thereof to provide a shoulder cover to be mounted on an aerosol product which can be easily separated and removed from the main body of the used aerosol container at the time of classified garbage collection after use of the product, while maintaining the conventional performance so as not to be detached at all during use of the product, thereby conforming to the container and package recycling promotion act and achieving perfectly and easily the classified garbage collection regulation demanding "the actuators including the shoulder cover should be easily detachable."

A first aspect of the invention is as follows.

1. A shoulder cover comprising a hinge provided on the line in the direction of action of an actuator, at least one locking protrusion provided within 90 degrees to the right or left of the hinge on an inner circumference in a form of ring band fitting with an aerosol container, and a vertical groove capable of separating part of the ring band. 2. A shoulder cover of item 1, wherein the groove upper part of the vertical groove of the ring band is plural grooves starting from both ends of the hinge. 3. A shoulder cover of item 1 or 2, wherein the section of the groove portion of the vertical groove of the ring band is a curvature. 4. A shoulder cover of any one of items 1 to 3, wherein a reinforcing band parallel to the ring band is formed in the grove portion of the vertical groove of the ring band. 5. A shoulder cover of any one of items 1 to 4, wherein the groove portion of the vertical groove of the ring band is single or plural I-forms. 6. A shoulder cover of any one of items 1 to 4, wherein the groove portion of the vertical groove of the ring band is a V-form. 7. A shoulder cover of any one of items 1 to 6, wherein a hinge thin film of greater width than the cut width ring band is provided in the hinge. 8. A shoulder cover of any one of items 1 to 7, wherein a penetration groove serving as part of a cutting portion when separated is formed in either the board or ring band, or in both, at proper positions. 9. A shoulder cover of any one of items 1 to 8, relating to a shoulder cover comprising plural ring bands, wherein there is an isolation penetration groove for isolating the ring band of the shoulder cover at a side not directly engaged with the fitting of the aerosol container, and the ring band of the shoulder cover at the side directly engaged with the fitting of the aerosol container, in either board or ring band, or in both, at proper positions, when removing the shoulder cover from the aerosol container.

A second aspect of the invention is as follows.

1. A shoulder cover of an aerosol container made of flexible resin, comprising a locking protrusion provided on an inner circumference of a ring band, and a grip provided on the ring band, being capable of inclining so as to flex the ring band. 2. A shoulder cover of item 1, wherein the locking protrusion provided on the inner circumference of the ring band is cut at least at one position in a direction vertical to the grip direction. 3. A shoulder cover of item 1 or 2, wherein plural grips capable of inclining in an inside direction of the ring band are formed. 4. A shoulder cover of any one of items 1 to 3, wherein a hinge is provided in the ring band, an actuator such as button or spout is formed on its extension, and the hinge is bent reversely so as to escape from the inclining range when bending the grip when detaching the shoulder cover. 5. A shoulder cover of any one of items 1 to 4, wherein the ring band in the cutting portion of the locking protrusion on the inner circumference of the ring band is finished thinner than the thickness of the portion of the other ring band. 6. A shoulder cover of any one of items 1 to 5, relating to a shoulder cover comprising plural ring bands, wherein there is an isolation penetration groove for isolating the ring band of the shoulder cover at a side not directly engaged with the fitting of the aerosol container, and the ring band of the shoulder cover at the side directly engaged with the fitting of the aerosol container, at proper positions of ring bands, when removing the shoulder cover from the aerosol container.

DETAILED DESCRIPTION OF THE PREFERRED EMBODIMENTS

Figure 1:
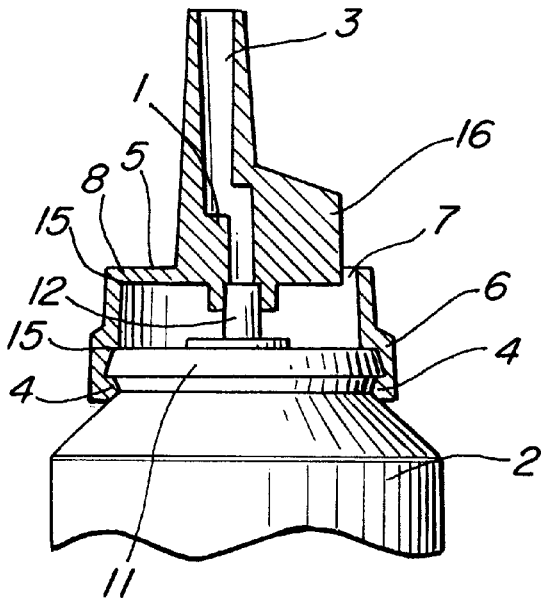
FIG. 1 is a partial cut section perspective view showing an example of an embodiment of a shoulder cover of the first invention.

Referring now to the drawings, some of the preferred embodiments of the invention are described in detail below.

Figure 2:
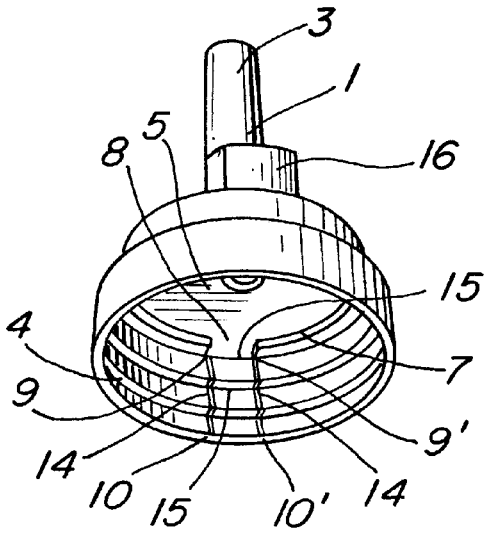
FIG. 2 is a perspective view showing an example of the embodiment of the first invention.

FIG. 1 is a partial cut section perspective view showing a mode of mounting a shoulder cover 1 on an aerosol container main body 2 in an embodiment of the first invention. FIG. 2 is a perspective view of the shoulder cover 1 seen obliquely from the back side.

In FIGS. 1 and 2, reference numeral 1 is the shoulder cover of the embodiment of the first invention. Reference numeral 2 is the aerosol container main body. Reference numeral 3 is a spout as an example of actuator, and it is fitted in the upper part of the aerosol container main body 2. This spout 3 has an operation button 16 manipulated when discharging the content from a nozzle core 12 from which the content is discharged. There is a board or support member 5 near the lower outer circumference of the spout 3, and it is linked to a ring band 6 fitted with the aerosol container main body 2 (main body valve 11, etc.) through a hinge 8.

In order that the shoulder cover 1 should never be detached from the aerosol container main body 2 during use of the product, at least one locking protrusion 4 is required in the portion within 90 degrees to right and left side of the hinge (the portion in the angle range shown in FIGS. 9 and 10) inside of the ring band 6. Without them, when the actuator such as spout or button is manipulated, the ring band 6 is flexed and it is likely to be detached.

The hinge 8 is provided on the line of direction of action of the spout 3 which is an actuator (the direction of the finger manipulating the spout 3). It makes smooth the motion of the spout 3 as actuator, and when tearing off the ring band 6 by holding the part of the spout 3, the tearing force from the spout 3 is fully utilized. If the hinge 8 is not located on the line in the direction of action, the motion of the spout 3 as an actuator is poor during use of the product, and it is hard to cut off the ring band 6.

In the board 5, moreover, a carved groove 7 is provided along the outer circumference of the board 5 from both ends of the hinge 8. In the ring band 6, there are vertical grooves 14 relative to the ring band 6, for cutting from both ends 9, 9' of the junction with the hinge 8 to lower ends 10, 10' of the ring band 6. That is, as set forth in claim 2, the groove upper portions of the vertical grooves 14 of the ring band 6 are formed of two (plural) grooves starting from both ends of the hinge 8, and therefore when tearing off the ring band 6 by holding the part of the spout 3, the tearing force from the spout 3 is more fully utilized. That is, if pulled obliquely to either right or left side instead of pulling the spout 3 straightly, cutting starts from either one of the two grooves, and the object of the invention may be easily achieved.

After use of the product, when separating and removing the shoulder cover 1 mounted on the aerosol product from the used container for classified garbage collection after use of the product, the spout 3 as the actuator of the shoulder cover 1 is held and pulled by force to the hinge 8 side, and cracks are formed in the vertical grooves 14 from the both ends 9, 9' of the junction of the ring band 6 and the hinge 8, and the cracks further propagate to the lower ends 10, 10', thereby cutting off the ring band 6 as the shoulder cover of the valve 11. The cut ring band 6 can be easily removed from the aerosol container main body 2, and therefore the shoulder cover 1 can be easily separated from the aerosol container main body 2, and the aerosol container main body 2 which is a metal and the shoulder cover 1 which is plastics can be disposed separately.

The vertical groove 14 for cutting may be formed either in plural lines or in a single line, and if not inconvenient in manufacturing, when the vertical grooves 14 are formed so that the lower ends 10, 10' of the ring band 6 may cross each other, that is, in a V-form intersecting at the lower parts, the spout 3 can be pulled down with a smaller effort. More specifically, when tearing off, unconsciously, the spout 3 is pulled at either right or left side, not straightly downward, and when the final point is immediately beneath the middle area of the spout 3, the ring band 6 can be cut off naturally with a smaller effort.

If not inconvenient in design, a cut portion or perforation may be provided in part of the vertical grooves 14, so that the vertical grooves 14 may be torn off with a smaller effort, and therefore the object of the invention may be achieved by a smaller force.

Figure 3:
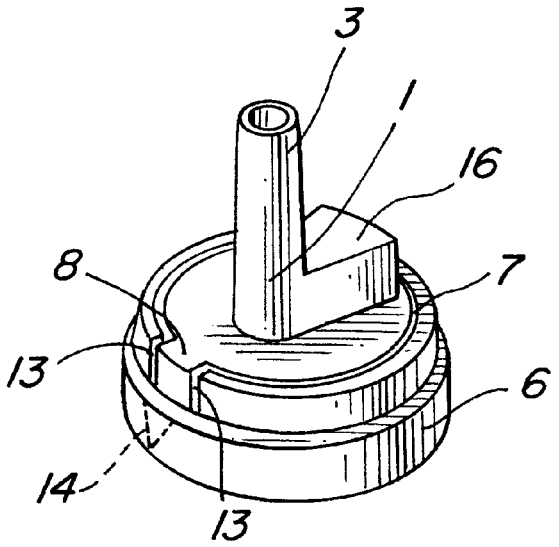
FIG. 3 is a perspective view showing an example of the embodiment of the first invention.

FIG. 3 is a perspective view of the shoulder cover 1 of the first embodiment, seen obliquely from above, and a cutting carved groove 13 is provided in part of the vertical grooves 14, and the vertical grooves 14 are formed in a V-form intersecting at the lower part of the ring band 6. In the following explanation, the members identified with the same reference numerals in FIG. 1 and FIG. 2 are the same or equivalent members, and their detailed description is omitted.

The shoulder cover 1 having plural ring bands 6 is described below.

Figure 4:
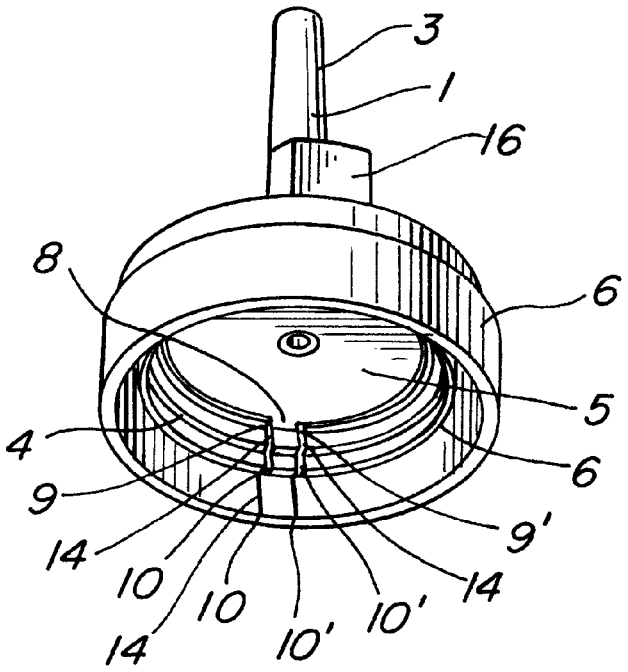
FIG. 4 is a perspective view showing an example of the embodiment of the first invention.

FIG. 4 is a perspective view of the shoulder cover 1 of the first embodiment having plural ring bands 6, as seen obliquely from the back side.

In the shoulder cover 1 having plural ring bands 6, same as in the case of a single ring band 6, the ring band 6 can be cut off in the ring band 6 fitted to the aerosol container main body 2, and if necessary, as shown in FIG. 4, the other ring band 6 can be cut off simultaneously, or if not necessary to cut off the other ring band 6 or if an extra (useless) large effort is needed to cut off, an isolation penetration groove may be formed at a position capable of isolating from the other ring band 6, so that the object of the invention may be easily achieved.

Figure 5:
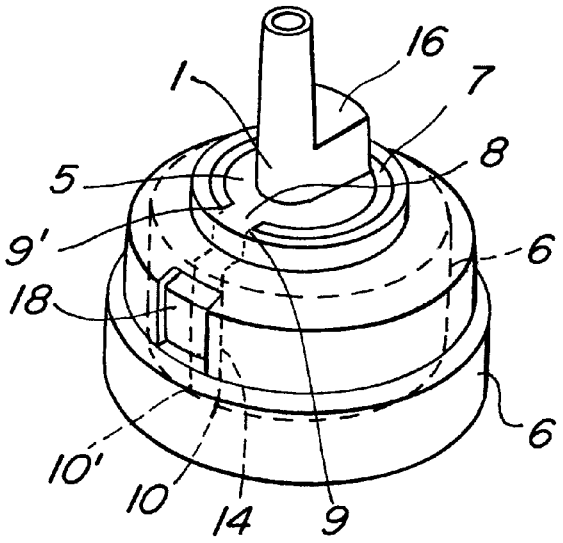
FIG. 5 is a perspective view showing an example of the embodiment of the first invention.

FIG. 5 is a perspective view of the shoulder cover 1 of the first embodiment, seen obliquely from above, in which an isolation penetration groove 18 is formed in the shoulder cover 1 having plural ring bands 6.

Figure 6:
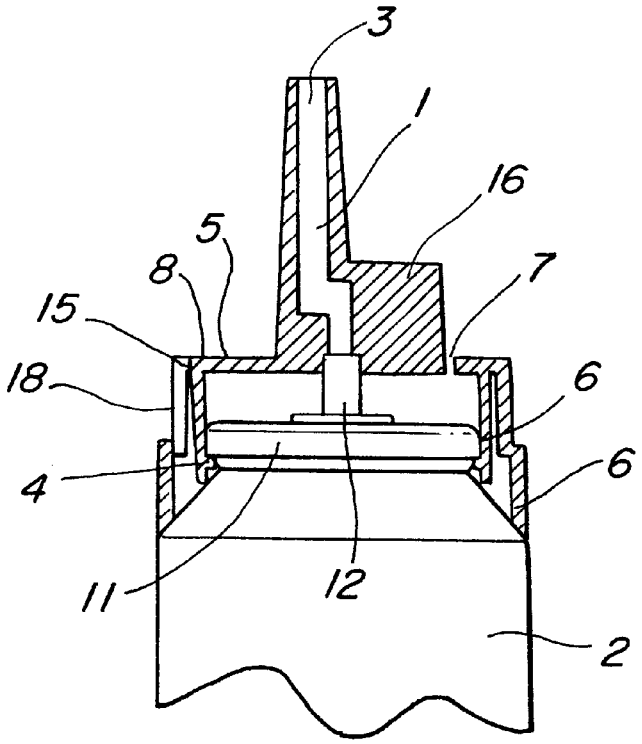
FIG. 6 is a partial cut section perspective view showing an example of the embodiment of the first invention.

FIG. 6 is a partial cut section perspective view of the shoulder cover 1 having plural ring bands 6 in FIG. 5 mounted on the aerosol container main body 2.

Figure 7:
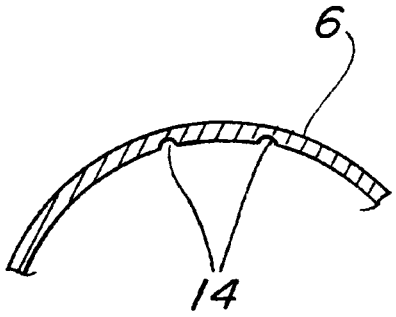
FIG. 7 is a magnified sectional view showing an example of the embodiment of the first invention.

FIG. 7 is a magnified sectional view of the groove portion of the vertical grooves 14 in an example in which the section of the groove portion of the vertical grooves 14 of the ring bands 6 of the first embodiment is a curvature.

By designing the section of the groove portion of the vertical grooves 14 of the ring bands 6 in a curvature, it prevents the ring band of the product from being torn off from around the vertical grooves 14 during long-term storage, or when operating the actuator during use of the product, the vertical grooves 14 of the ring bands 6 serve to lessen the load on the ring bands 6 due to excessive pulling applied through the hinge 8 during operation also in the ring band 6 lowered in strength, it hence prevents the ring band 6 from being torn off around the vertical grooves 14 and the shoulder cover 1 from being detached from the aerosol container main body 2.

Figure 8:
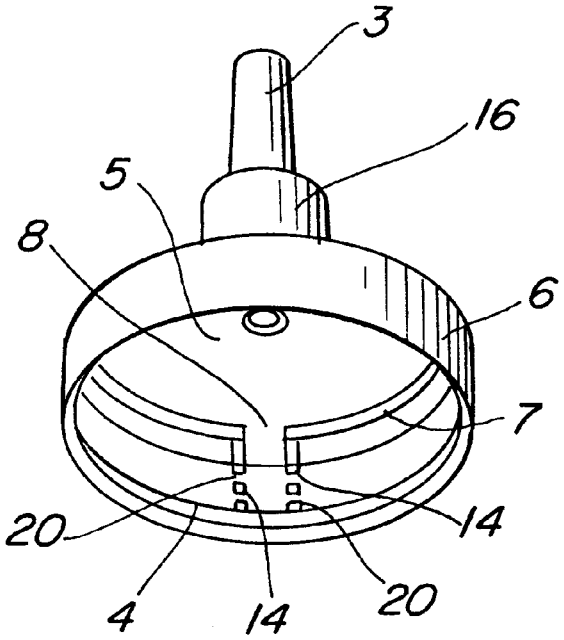
FIG. 8 is a perspective view showing an example of the embodiment of the first invention.

FIG. 8 is a perspective view showing an embodiment of the portion of the vertical grooves 14 of the ring band 6 of the first embodiment, in which reinforcing bands 20 parallel to the ring bands 6 are provided in the groove portion of the vertical grooves 14 of the ring bands 6. Same as in the curvature section of the groove portion of the vertical grooves 14 of the ring bands 6, it is effective to prevent tearing of the ring bands 6 during long-term storage of products, and the vertical grooves 14 of the ring bands 6 provided through the hinge 8 serve to lessen the load due to excessive pulling and the like applied in the ring bands 6 lowered in strength, at the time of actuation of the actuator (spout 3) during use of product, thereby preventing the ring band 6 from being torn off around the vertical grooves 14 and the shoulder cover 1 from being detached from the aerosol container main body 2. When combined with the curvature section of the groove portion of the vertical grooves 14, ring bands 6 having a stabler strength may be obtained.

Figure 9:
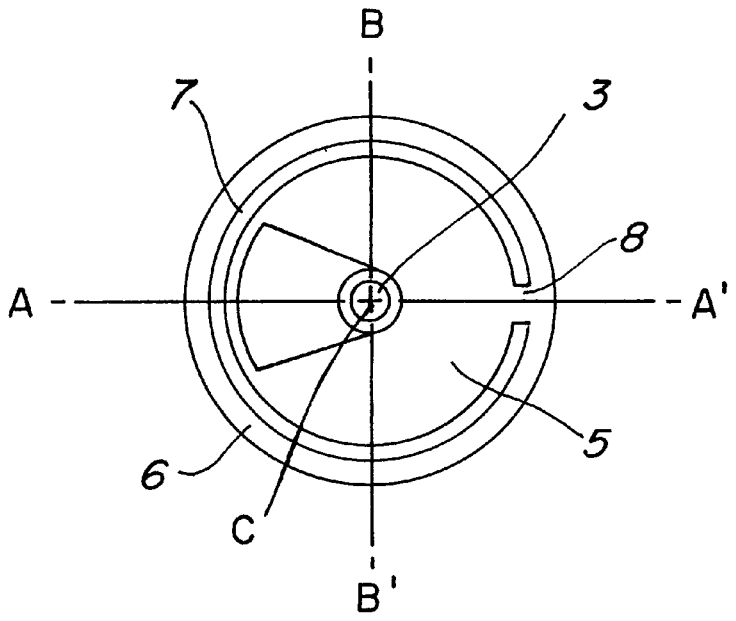
FIG. 9 is an outline view showing an example of the embodiment of the first invention.
Figure 10:
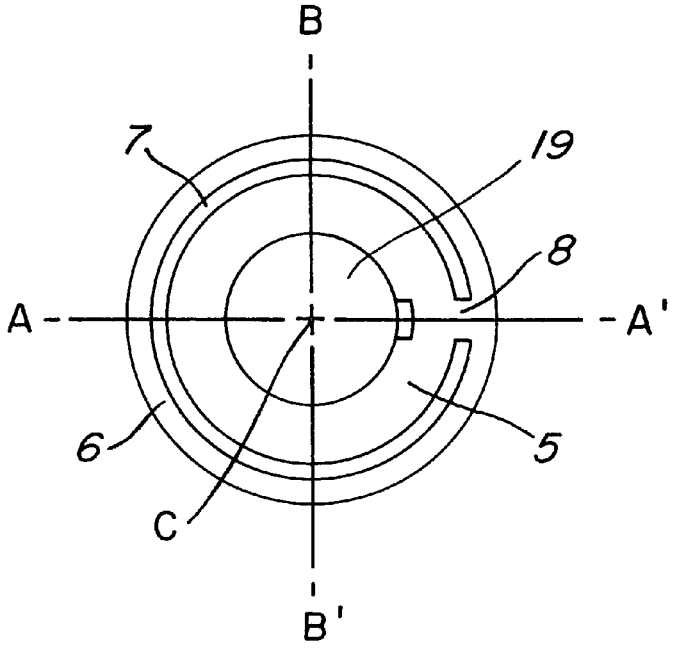
FIG. 10 is an outline view showing an example of the embodiment of the first invention.

FIG. 9 is an explanatory diagram showing the appearance as seen from above, in which the actuator of the shoulder cover 1 of the first embodiment is the spout 3, and FIG. 10 shows that the actuator of the shoulder cover 1 of the first embodiment is a button 19. Herein, A-A' denotes the direction of action (the finger direction when manipulating) of the actuator, that is, spout 3 or button 19.

In the embodiment in FIG. 9 and FIG. 10, since the hinge 8 is located at the A' side on the line A-A', the range of angle of within 90 degrees to right and left of the hinge in claim 1 indicates the range of angles of <A'CB and <A'CB' formed at the intersection C of line segment B-B' vertical to line segment A-A' and line segment A-A'. When the hinge 8 is at side A of line A-A', the range of angle of within 90 degrees to right and left of the hinge means the range of angles of <ACB and <ACB'.

Figure 11:
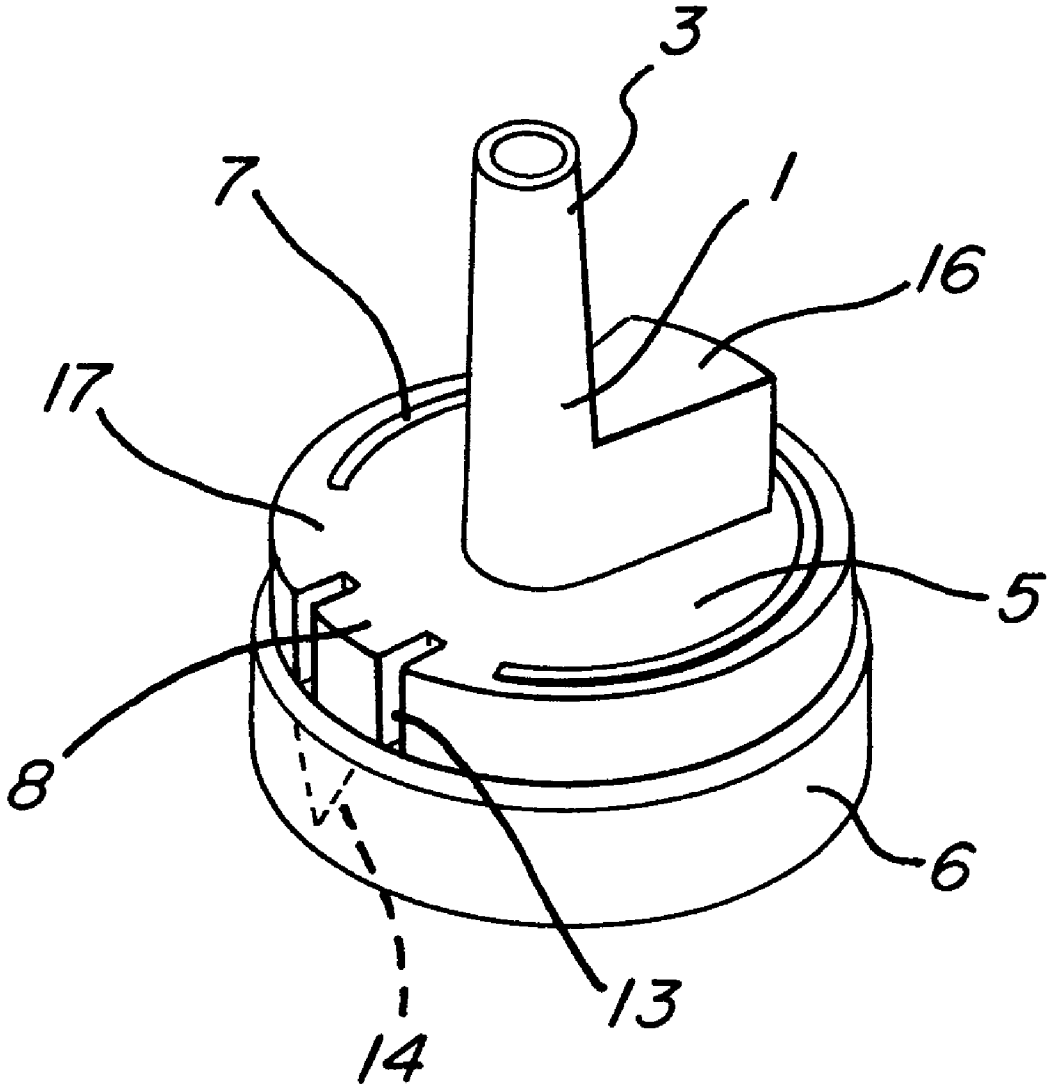
FIG. 11 is a perspective view showing an example of the embodiment of the first invention.

FIG. 11 shows an embodiment of the first invention, in which a hinge thin film 17 of a greater width than the cutting width (ring band separating width) of the ring band 6 is formed at right and left of the hinge 8 to prevent from tearing off the hinge 8 when operating the actuator or to eliminate instability in operation, during use of the product. Accordingly, the operation of the actuator is much stabler.

In the foregoing embodiments, the actuator of the shoulder cover 1 of the invention is the spout 3, but the invention is exactly the same if the spout 3 is replaced by another actuator such as the button 19.

In the first embodiment of the invention, when cutting from the shoulder cover 1 to the board 5 and ring band 6 progressively at the time of cutting, the cutting job may be done more smoothly when the folding junction 15 is formed in a curvature without a corner so that the ring band 6 may not be cut off until cutting is complete.

Figure 12:
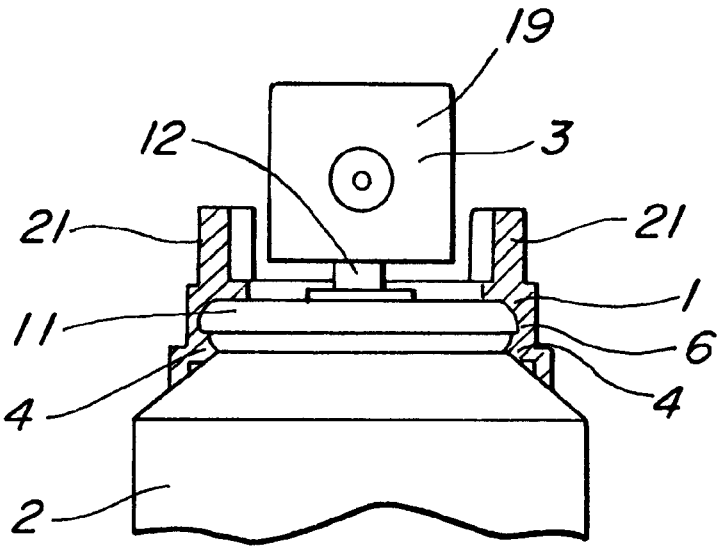
FIG. 12 is a partial cut section perspective view showing an example of an embodiment of a shoulder cover of the second invention.

FIG. 12 is a partial cut section perspective view showing the shoulder cover 1 mounted on the aerosol container main body 2 in a second embodiment of the invention. In FIG. 12, reference numeral 1 denotes a shoulder cover made of a flexible resin as one embodiment of the invention. Reference numeral 2 is an aerosol container main body. Reference numeral 21 is a grip, which is provided in the upper part of the ring band 6, and it is provided at a proper position of the ring band 6 so that the ring band 6 may be flexed by acting on the grip 21.

Inside of the ring band 6, a locking protrusion 4 is formed, and fitted with the aerosol main container main body 2 (and/or with the valve 11 fitted to the aerosol container main body 2, or the like). An actuator 3 is provided in a nozzle core 12 of the valve 11 fitted to the aerosol container main body 2.

Figure 13:
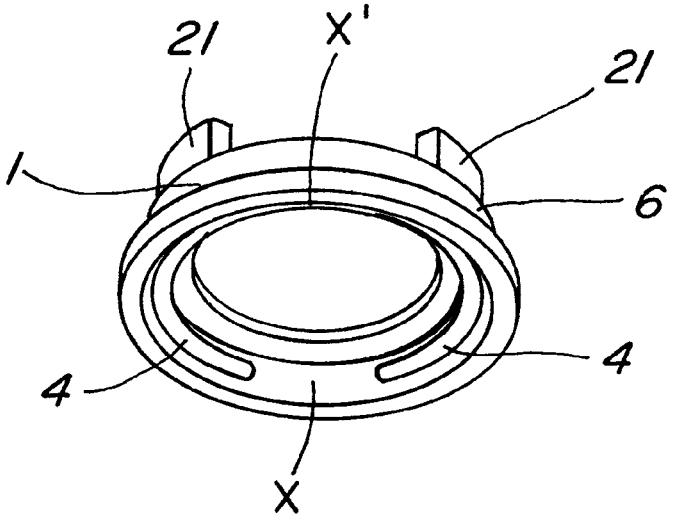
FIG. 13 is a perspective view showing an example of the embodiment of the second invention.

FIG. 13 is a perspective view of the shoulder cover 1 in the second embodiment of the invention, as seen obliquely from the back side, in which the locking protrusion 4 is cut in a direction X (or X and X') vertical to the mounting direction of the grip 21.

Figure 14:
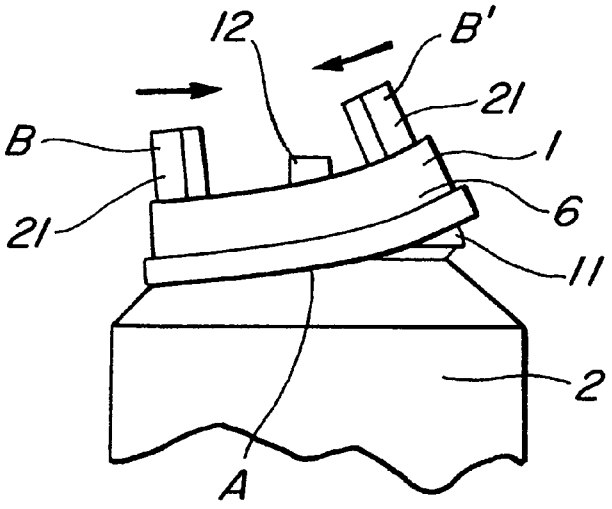
FIG. 14 is a perspective view showing an example of the embodiment of the second invention.

FIG. 14 is a perspective view showing an example of separating the shoulder cover 1 of a flexible resin from the aerosol container main body 2, in which the portion of the grip 21 is pulled upward by picking up in the inside direction (arrow direction) of the ring band 6, after removing the button 19 or the actuator 3, from the state in FIG. 12. In the following explanations, same reference numerals are provided for the same components shown in FIGS. 12 and 13, and repeated descriptions are omitted.

After use of the product, when separating and removing the shoulder cover 1 mounted on the aerosol product from the used container for classified garbage collection after use of the product, by grasping firmly around B, B' of the grip 21, the grip 21 can be inclined so as to flex the ring band 6, and therefore the shoulder cover 1 of flexible resin is formed elliptically and extended in the direction of the grip 21, in the lower portion of the ring band 6, and the locking protrusion 4 provided inside of the ring band 6 is lifted above the valve 11 or the like of the aerosol container main body 2. At the same time, the junction of the inside or lower end portion of the ring band 6 contacting with the aerosol container main body 2 (for example, the portion A) serves as the fulcrum, and it helps the locking protrusion 4 to slip out of the aerosol container main body 2, and by the synergistic effects of the two, the shoulder cover 1 can be easily dismounted from the aerosol container main body 2. Of course, it is needless to say more effective to pick up when pulling up the grip 21.

The effect of the invention may be more easily enhanced by providing the grip 21 with an anti-skid protrusion 22 or anti-skid groove as a means for preventing from skidding.

When dismounting, in order that the lower portion of the ring band 6 of the shoulder cover 1 may be formed more easily into an elliptical form extended in the direction of the grip 21, it is preferred to finish the entire ring band 6 as thinly as possible also from the viewpoint of design as far as the strength permits. The ring band 6 in the portion of separating portion (X or X, X' shown in FIG. 13) of the locking protrusion 4 in a direction vertical to the direction of the grip 21 should be finished as thin as possible within the strength, if the other ring band 6 portion is thicker, so that the effects of the invention may be enhanced easily.

Figure 15:
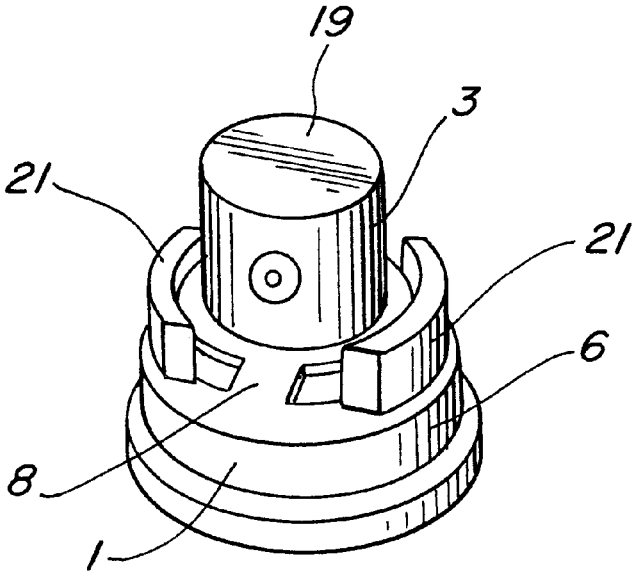
FIG. 15 is a perspective view showing an example of the embodiment of the second invention.

FIG. 15 is an outline perspective view showing an embodiment of the shoulder cover 1 in a second embodiment of the invention, in which the hinge 8 is provided in the ring band 6, and the actuator such as button 19 and spout 3 is provided on its extension. In FIG. 15, the button 19 is used as the actuator.

Figure 16:
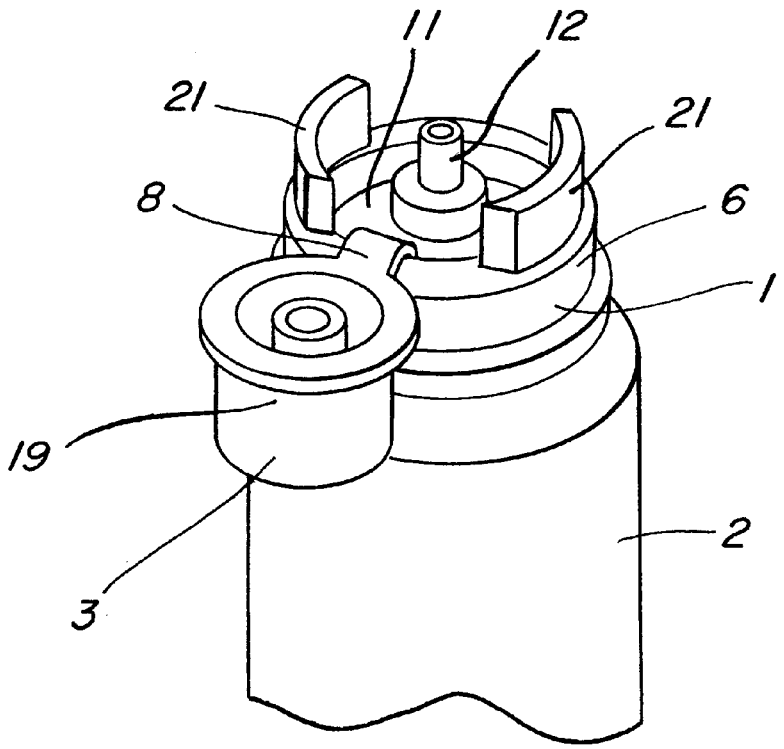
FIG. 16 is a perspective view showing an example of the embodiment of the second invention.

FIG. 16 is an outline perspective view showing an intermediate process of the procedure of separating and removing the aerosol product mounting the shoulder cover 1 with the actuator in the example shown in FIG. 15, from the used container for classified garbage collection after use of the product. After use of the product, the actuator is removed from the nozzle core 12, the actuator is bent to the hinge 8 side, and the grip 21 can be inclined inside of the ring band 6. When the grip 21 is picked up by force, the lower portion of the ring ban 6 is made into an elliptical form extended in the direction of the grip 21, and, as explained in FIG. 14, the locking protrusion 4 inside of the ring band 6 is raised above the valve 11 or the like of the aerosol container main body 2, so that the shoulder cover 1 may be easily detached from the aerosol container main body 2.

Figure 17:
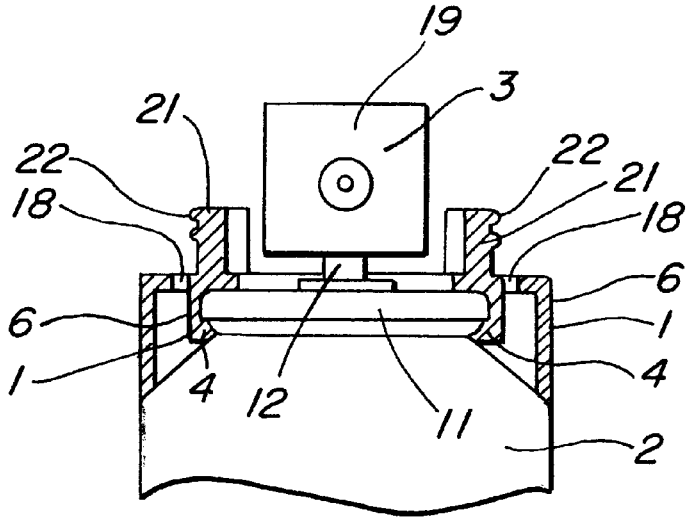
FIG. 17 is a partial cut section perspective view showing an example of the embodiment of the second invention.

A shoulder cover 1 having plural ring bands 6 is described below. FIG. 17 is a partial cut section perspective view of mounting the shoulder cover 1 of the second invention having plural ring bands 6 on the aerosol container main body 2.

In the shoulder cover 1 having plural ring bands 6, same as in the shoulder cover with a single ring band, the ring band 6 of the shoulder cover 1 of the side fitted with the aerosol container main body 2 should be formed elliptically when the grip 21 is picked up by force. For this purpose, a most appropriate material may be selected, or the thickness or structure of the junction of the inside should cover 1 and outside shoulder cover 1 may be properly designed, and it is possible to manufacture without any particular difficulty, but in order to move smoothly the ring band 6 of the shoulder cover 1 fitted with the aerosol container main body 2 by picking up the grip 21, if the unnecessary one of the ring bands 6 may disturb, or an extra effort may be needed to remove the unnecessary one of the ring bands 6, or the force is not transmitted correctly to the side fitted with the aerosol container main body 2, as shown in FIG. 17, the object of the second embodiment may be achieved easily by forming an isolation penetration groove 18 at a proper position so as to be isolated from the other shoulder cover.

In the examples of the shoulder cover 1 in the second embodiment, the button 19 is used as an example of the actuator, but it is the same if the button 19 is replaced by another actuator such as a spout.

In the above described embodiments, the flexible resin used as the shoulder cover 1 may be polyethylene, polypropylene, or other flexible resin among the resins so far used in the shoulder cover, actuator, cap, and others, and any other resins may be used as far as having equivalent performances.

As described herein, in the shoulder cover of the present invention, the shoulder cover 1 can be easily dismounted from the aerosol container main body 2. In particular, as in the first embodiment, when the hinge is formed on the line in the direction of action of the actuator, and at least one locking protrusion, and vertical groove for separating part of ring band are formed within 90 degrees to right and left of the hinge on the inner circumference of the ring band fitted with the aerosol container, and thereby the hinge 8, board 5, and spout 3 as actuator are linked immediately above the cut section of the ring band 6, and this spout 3 may be held to pull apart, so that separating procedure is easier. Hence, the metal parts and resin parts may be easily separated from the aerosol container main body 2.

Moreover, this invention may be executed without raising the cost at all, and the object can be achieved without requiring any burden on the consumers, and it is possible to execute without practically changing the design of existing products. It can be applied in various products in a short period, and its contribution to the society is outstanding.

Or, as in the second embodiment, by forming a locking protrusion on the inner circumference of the ring band, and disposing a grip capable of inclining so as to flex the ring band on the ring band, if necessary to remove or replace the shoulder cover 1 in the manufacturing process due to some reason, the shoulder cover 1 can be detached without tearing or breaking the aerosol container main body 2 by mistake, and hence it is free from danger or defect, and is safe and economical.

The shoulder cover 1 can be easily detached from the aerosol container main body 2, and hence the metal parts and resin parts can be easily separated from the aerosol container main body 2. In particular, the shoulder cover 1 is not damaged or torn when dismounting, and the button 19 or spout or other actuator 3 may be removed before dismounting the shoulder cover 1 from the aerosol container main body 2, or by disposing in a place not disturbing the inclination of the grip 21, only by picking up the grip 21 by force, the shoulder cover 1 can be detached from the aerosol container main body 2, so that the invention may be executed without practically damaging the shoulder cover 1 itself, as well as the aerosol container main body 2.

The shoulder cover 1 may be reused if necessary and it is economical, and it is also preferably from the viewpoint of ecology. Besides, the invention can be executed without practically increasing the cost, and the object of the invention is achieved without increasing burden for the consumers, and it is possible to execute by changing the design of existing products only very slightly. Moreover, it can be applied in various products in a short period, and its contribution to society is outstanding.

If necessary to remove or replace the shoulder cover 1 due to some reason during manufacture, the shoulder cover 1 can be removed without tearing or damaging the aerosol container main body 2 by mistake, and it is free from danger or defect, and it is also safe and economical.

What is claimed is:

1. A detachable shoulder cover comprising:

a ring band configured to attach to an aerosol container;

a nozzle type actuator through which aerosol contents are dispensed, wherein the actuator acts as a lever for detaching the shoulder cover prior to discarding;

a hinge provided on a line in the direction of action of the actuator;

at least one locking protrusion provided within 90 degrees to the right or left of the hinge on an inner circumference in the form of a separating part of the ring band; and a first groove pattern extending from adjacent a top of the ring band to adjacent a bottom of the ring band, the groove pattern separates when a force is applied in a predetermined direction, thereby rending the ring band along the groove pattern.

2. A shoulder cover as set forth in claim 1, wherein the groove upper part of the vertical groove of the ring band is plural grooves starting from both ends of the hinge.

3. A shoulder cover as set forth in claim 1, wherein the section of a groove portion of the vertical groove of the ring band is a curvature.

4. A shoulder cover as set forth in claim 3, wherein a reinforcing band parallel to the ring band is formed in the grove portion of the vertical groove of the ring band.

5. A shoulder cover as set forth in claim 4, wherein the groove portion of the vertical groove of the ring band is single or plural I-forms.

6. A shoulder cover as set forth claim 1, wherein a second groove intersects the first groove at a point proximate a bottom edge of the ring band, thereby forming a V-shaped groove pattern.

7. A shoulder cover as set forth in claim 1, wherein a hinge thin film of greater width than a cut width of the ring band is provided in the hinge.

8. A shoulder cover as set forth claim 1, wherein a surface abutting the upper edge of the ring band at right angles is a board, said board having an equal number of grooves as the ring band, and wherein each board groove begins at a point where a groove on the ring band proximately intersects the board and extends radially inward toward a center point of the board.

9. The invention of claim 1 wherein the first groove pattern is perforated for easier tearing when detachment is performed.

10. The invention of claim 1 wherein a second groove pattern is disposed on the ring band in a vertical orientation, the first and second groove patterns thereby being essentially parallel.

11. A removable shoulder cover and actuator assembly for an aerosol container with a pressure responsive dispenser nozzle core, comprising:

a ring band that fits around a top of the aerosol can;

a first groove pattern extending adjacent a top of the ring band to adjacent a bottom of the ring band which severs when a predetermined force is applied, thereby rending the ring band;

a connecting member for locking onto an aerosol container adjacent the dispenser nozzle core;

a cantilevered nozzle member pivotably connected to the connecting member and positioned relative to the connecting member so that it is above the dispenser nozzle core when mounted on the aerosol container; and means on the nozzle member to connect the nozzle member to the dispenser nozzle core, whereby the exertion of a force on the nozzle member will activate the pressure responsive dispenser nozzle core to release the contents of the aerosol container through the nozzle member.

12. The invention of claim 11 wherein the cantilevered nozzle member is configured to provide an operation button.

13. The invention of claim 11 wherein a second groove is disposed on the ring band in a vertical orientation, the first and second grooves thereby being essentially parallel.

14. The invention of claim 11 wherein the connecting member includes locking protrusions on either side of the pivotal connection.

15. The invention of claim 14 wherein a hinge portion interconnects the connecting member with the cantilevered nozzle member and the entire removable shoulder cover and actuator assembly are integrally formed of a plastic resin.

16. The invention of claim 11 wherein a second groove is disposed on the ring band to intersect the first groove proximate a bottom edge of the ring band, thereby forming a v-shaped groove pattern.

17. The invention of claim 11 wherein the first groove pattern is perforated for easier tearing when detachment is performed.

18. The invention of claim 11 wherein a surface abutting the upper edge of the ring band at right angles is a board, said board having an equal number of grooves as the ring band, and wherein each board groove begins at a point where a groove on the ring band proximately intersects the board and extends radially inward toward a center point of the board.

19. A removable shoulder cover and actuator assembly for an aerosol container with a pressure sensitive dispenser nozzle core, comprising:

an annular member for securement onto an aerosol container adjacent the dispenser nozzle;

an actuator pivotably connected to the annular member;

a hinge member pivotably connecting the actuator member to an upper edge of the annular member, the actuator member is cantilevered from one portion of the annular member to be positioned above the dispenser nozzle core when mounted on the aerosol container;

means on the actuator member to connect the actuator member to the dispenser nozzle core, whereby an exertion of a force on the actuator member will activate the pressure responsive nozzle core to release the contents of the aerosol container through the actuator member; and a groove pattern extending adjacent the upper edge of the annular member and the hinge member through the annular member to a position adjacent a lower edge of the annular member to provide a section of the annular member that is structurally weaker than the remainder of the annular member to a force applied in a predetermined direction, when the actuator member is pulled in the predetermined direction away from the dispenser nozzle core a distance sufficient to move the hinge member to bend across the annular member the groove pattern tears to separate the annular member from the aerosol container.

* * * * *